United States Patent [19]

Patterson

[11] 4,091,945

[45] May 30, 1978

[54] TILE SETTING APPARATUS

[76] Inventor: Thomas P. Patterson, 3138 W. Sells Dr., Phoenix, Ariz. 85017

[21] Appl. No.: 649,026

[22] Filed: Jan. 14, 1976

[51] Int. Cl.[2] ..... B65G 65/38

[52] U.S. Cl. ..... 214/309; 206/322; 214/1 BS; 214/8.5 D; 294/64 R

[58] Field of Search ..... 220/22, 6, 19; 217/8, 217/9; 206/322; 214/1 R, 1 BS, 309, 8.5 R, 8.5 D, 6 S; 294/64 R, 64 A, 64 B, 65

[56] References Cited

U.S. PATENT DOCUMENTS

| | | | |
|---|---|---|---|
| 1,431,702 | 10/1922 | Smend et al. | 294/64 X |
| 2,147,907 | 2/1939 | MacChesney | 294/64 R X |
| 2,203,240 | 6/1940 | Tipton | 217/8 |
| 2,303,393 | 12/1942 | Schmidt | 294/65 X |
| 2,308,209 | 1/1943 | Schmutzer et al. | 294/65 |
| 2,602,554 | 7/1952 | Griffith | 214/6 S X |
| 2,798,757 | 9/1957 | Jacuson | 294/64 R |
| 2,960,364 | 11/1960 | Herzog | 294/65 |
| 2,994,441 | 8/1961 | Browning, Jr. | 220/19 X |
| 3,033,604 | 5/1962 | Ammon | 294/64 R |
| 3,195,941 | 7/1965 | Morey | 294/64 R |
| 3,400,843 | 9/1968 | Johnson | 214/309 |
| 3,556,326 | 1/1971 | Cline | 214/6 S X |
| 3,643,992 | 2/1972 | Jacobucci | 294/64 R X |
| 3,765,542 | 10/1973 | White | 214/309 X |

*Primary Examiner*—Frank E. Werner
*Attorney, Agent, or Firm*—H. Gordon Shields

[57] ABSTRACT

Tile setting apparatus is disclosed which includes a tile holder box for both holding and aligning tiles preparatory to installation of the tiles and a tile setter tool which is releasably secured to the tiles in the tile holder box and removes a plurality of the aligned tiles from the tile holder for placement of the tile for installation.

18 Claims, 18 Drawing Figures

FIG-6
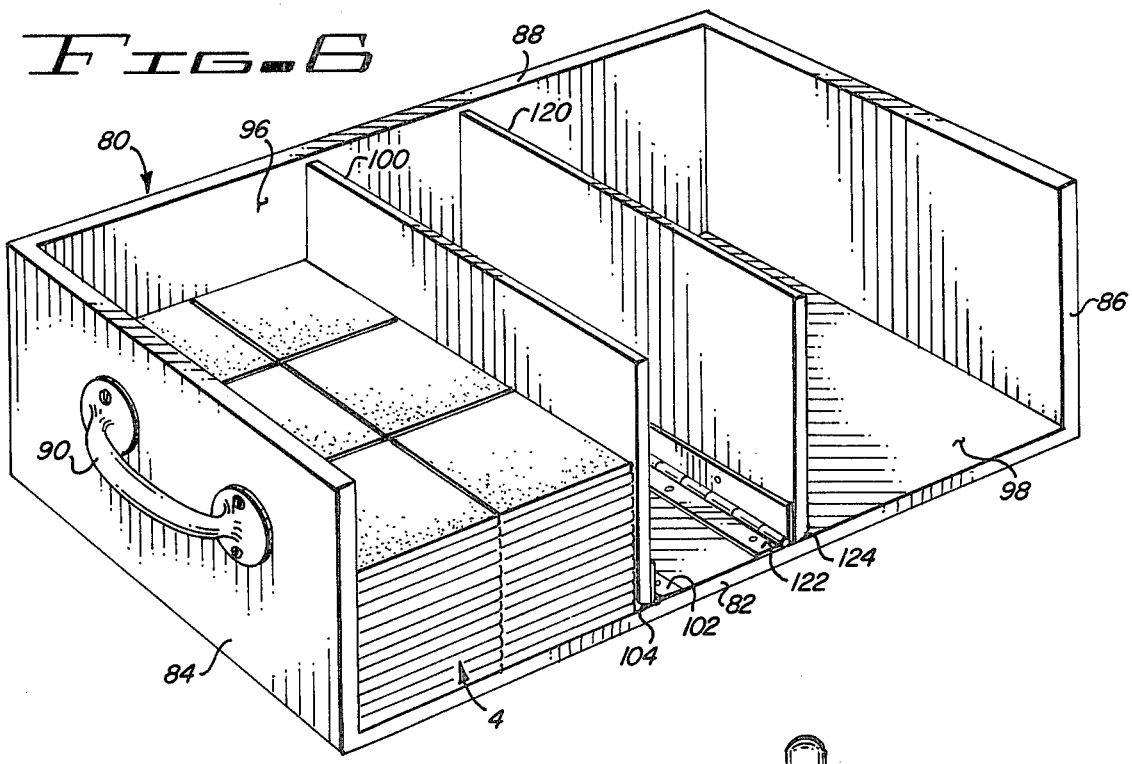
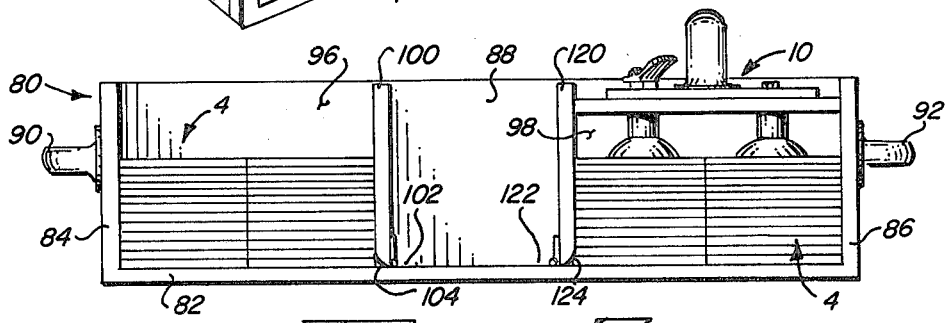
FIG-7
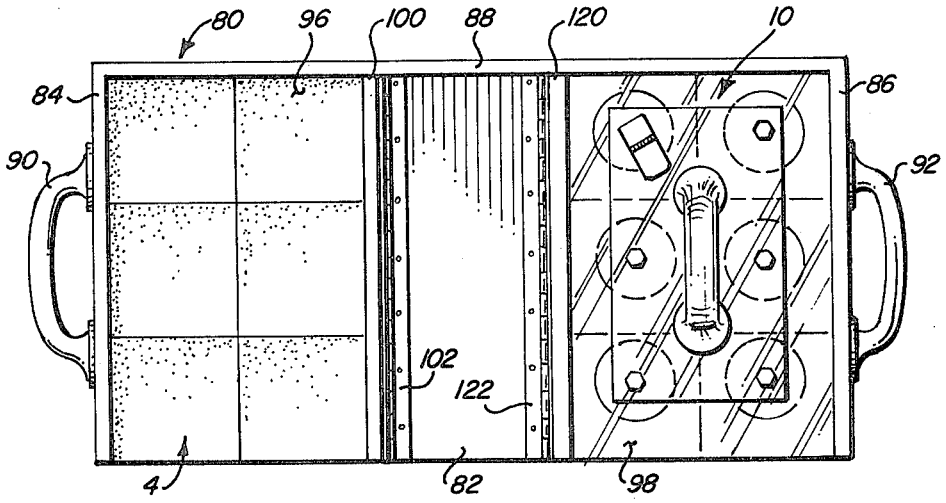
FIG-8

TILE SETTING APPARATUS

BACKGROUND OF THE INVENTION

1. Field of the Invention

This invention relates to tile setting apparatus, and more particularly, to cooperating box apparatus for holding a plurality of ceramic-type tiles in a particular orientation and tile setter apparatus which removes a plurality of such tile from the holder box for installing the tiles in the same orientation of the tiles as aligned and held in the box.

2. Background of the Invention

Ceramic tile is manufactured in a variety of shapes and sizes. For typical wall installation, such as in bathrooms and kitchens, tiles are normally about four and a quarter inches square and about one quarter to five-sixteenths inches thick. A tile setter prepares a wall for installation of tile by using some type of mastic on the wall to which the tiles adhere and to which the tiles are then grouted after initial installation. A sheet of material with an adhesive or mastic on both sides is typically used. A tile setter normally installs the tiles one square at a time by removing a single tile from a supply box and by installing the single tile. The tiles are then laid adjacent each other and are oriented with respect to each other from a base line, or a pair of base lines, usually a vertically extending line and a horizontally extending line which intersect at right angles.

Tiles are supplied in a box, usually in the box in which they are packed by the manufacturer and in which they are shipped. Since tiles are quite heavy, they are normally packed in relatively small boxes which are yet rather heavy. Typically boxes are marked, and the tiles are so packed, according to the square footage of surface area, usually about ten square feet, of the tiles in the box rather than the weight of the loaded box. In most situations, tiles are aligned parallel in boxes, disposed on an edge rather than flat.

Maximum efficiency of a worker is obtained by allowing him, the tile setter, to set a plurality of tiles in a single operation. This is difficult to accomplish because of the orientation of tiles in supply boxes and because of the inability of the tile setter to set more than one tile at a time and to orient each single tile in order to maintain the desired alignment of adjacent tiles in a pattern or, in the case of square or rectangular tiles, in an appropriate or desired square or rectangular arrangement and alignment. The efficiency of a tile setter is improved if tiles can be oriented properly for him and if he is able to pick up in a single operation a plurality of tiles appropriately oriented and if he can then maintain the appropriate orientation during simultaneous installation of the plurality of tiles.

Suction cups may be used to pick up a tile, or a plurality of tiles, providing the tiles are smooth enough to allow the suction cups to maintain the necessary vacuum attachment. However, for a textured tile, the maintaining of the desired suction or vacuum for attachment may not be of sufficient time to allow the setting of the tile. Accordingly, a vacuum attachment which is able to provide the necessary adherence to both smooth and textured tile is preferable in order to accomplish the tile setting of a plurality of tiles in a single operation. The apparatus described and claimed herein accomplishes the above described requirements for setting the plurality of tiles in a single operation.

SUMMARY OF THE INVENTION

The apparatus disclosed and claimed herein comprises tile holding and orienting box or container for holding and orienting the tiles in layers and a hand held and operated tile setter tool which cooperates with the box or holder and which includes a plurality of suction cups which adhere to the tiles in the box apparatus and which maintain the alignment of the tiles during the setting of the tiles and until the tiles are substantially simultaneously released.

Among the objects of the present invention are the following:

To provide new and useful tile setting apparatus;

To provide a new and useful tile holder apparatus;

To provide a new and useful tile setter apparatus which cooperates with a tile holding apparatus;

To provide a new and useful vacuum apparatus for holding a plurality of tiles;

To provide new and useful tile holding apparatus for holding a plurality of tiles;

To provide new and useful tile holding apparatus for holding a plurality of tiles;

To provide new and useful tile holding apparatus for maintaining an orientation of the tiles;

To provide a new and useful tile setter apparatus for setting a plurality of tiles in a single operation;

To provide new and useful box apparatus for positioning a plurality of tiles in a predetermined orientation;

To provide new and useful tile setter apparatus for holding a plurality of tiles in a predetermined orientation;

To provide new and useful apparatus for holding a plurality of tiles and for setting the tiles held by the holding apparatus;

To provide a new and useful hand operated tile setting apparatus;

To provide new and useful tile setting apparatus for holding and orienting a plurality of tile by vacuum pressure;

To provide new and useful tile setting apparatus including a releasable vacuum arrangement for holding and orienting a plurality of tiles; and To provide new and useful tile setting apparatus including a hand operated vacuum tool which cooperates with a tile holder both for orienting and setting a plurality of tiles.

BRIEF DESCRIPTION OF THE DRAWING

FIG. 6 is a perspective view of the tile holder box of the present invention with a plurality of tiles disposed and oriented therein.

FIG. 7 is a side view of the apparatus of FIG. 6, illustrating a plurality of tiles disposed therein and illustrating the use of the tile setter apparatus of FIGS. 1–5 cooperating with the box.

FIG. 8 is a vertical plan view of the apparatus of FIG. 7.

DESCRIPTION OF THE PREFERRED EMBODIMENT

Figure 1:
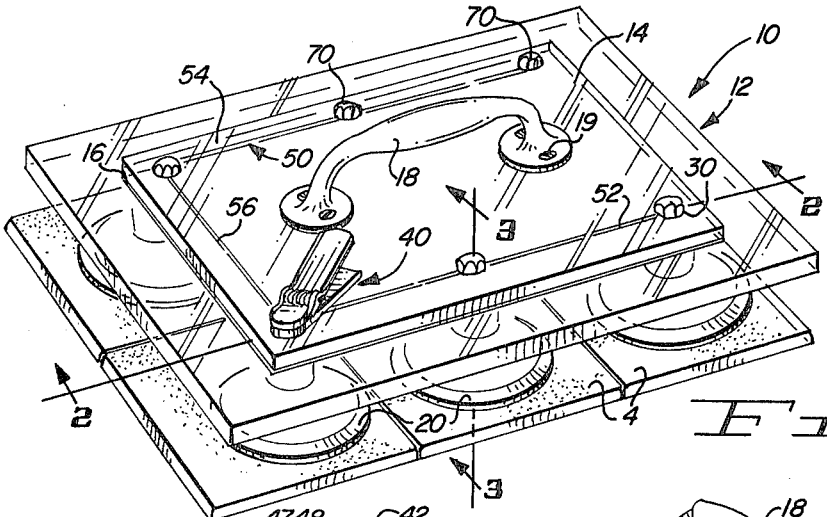
FIG. 1 is a perspective view of a tile setting apparatus illustrating its use with a plurality of tiles secured to the apparatus.

FIG. 1 is a perspective view of a portion of the tile setting apparatus of the present invention, illustrating the use of the apparatus with a plurality of tiles secured to the apparatus. The tile setting apparatus of the present invention comprises a pair of cooperating elements, tile setter 10, and a tile holder box 80 (see FIGS. 6, 7, and 8). The tile setter 10 is illustrated in FIGS. 1–5, and is also shown in phantom in FIGS. 7 and 8.

The tile setter 10 includes a base plate 12, a top plate 14 disposed on and secured to the base plate, and separated from the base plate by a sealing gasket 16. The top plate, as its name implies, is disposed on the base plate 12. More specifically, the top plate 14 is centrally located on upper surface 13 of the base plate, with the sealing gasket 16 disposed between the two plates. The sealing gasket 16 is substantially the same size as the top plate and accordingly covers only the center rectangular portion of the top surface 13 of the base plate 12. Extending beneath the base plate 12, and secured thereto, are a plurality of suction cups 16. As illustrated in FIG. 1, and also in FIGS. 5 and 6, six suction cups are secured to the base plate for securement directly to a plurality (six) of individual tiles 4. The tiles as illustrated are square in configuration and are disposed adjacent each other in a rectangular pattern. The base plate is rectangularly configured so as to be substantially the same size in length and width as are the six tiles. The reason for this will be brought out in detail below in conjunction with the discussion of the tile holder box illustrated in FIGS. 6–8.

The base plate is secured to the suction cups and also to the top plate and sealing gasket by a plurality of appropriate fasteners, such as bolts or screws 70 which extend downwardly from the top plate through the sealing gasket, through the base plate, and into internally threaded portions of the suction cups. On the top or upper surface of the top plate 16 is a handle 18 which is secured to the top plate by a plurality of screws 19. The handle is preferably centrally located with respect to the top plate 14 and accordingly centrally located on the tile setter apparatus 10, with the longitudinal axis of the handle in line with the longitudinal axis, or length, of the tile setter and the top plate. The obvious reason for centrally locating the handle is to appropriately balance the load of the tiles 4 during the use of the tile setter apparatus to install the plurality of tiles held by the suction cups.

Adjacent the forward end of the handle 18, and disposed outwardly and forwardly thereof, is a thumb release valve 40. The thumb release is appropriately located so as to enable a user of the apparatus to actuate the thumb release valve with his thumb to release vacuum pressure in an air chamber 50 on the upper side of the base plate 12.

The air chamber 50 comprises a pair of longitudinal runners 52 and 54 and a lateral runner 56 which extends between the two longitudinal runners. The longitudinal runners 52 and 54 extend over the top of the six suction cups and communicate with the suction cups through a plurality of vertical conduits, illustrated in detail in FIGS. 2 and 3. The thumb release 40 communicates with the air chamber 50 to release the vacuum pressure therein.

Figure 2:
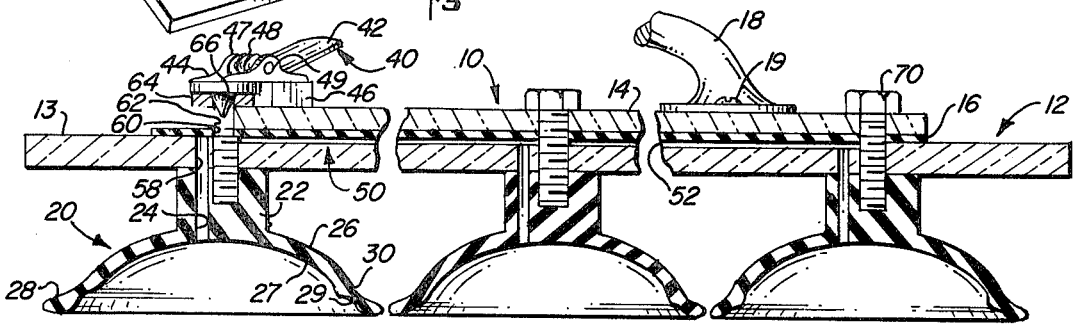
FIG. 2 is a view of the apparatus of FIG. 1 in partial section, taken generally along lines 2—2 of FIG. 1.

FIG. 2 is a view of the tile setter apparatus 10 of FIG. 1 in partial section taken along line 2—2 of FIG. 1. A portion of handle 18 is shown broken away in FIG. 2, but the disposition of the handle on the top plate 14 is clearly shown, and the securing of the handle 18 as by screws 19 is also shown. The base plate 12 is shown with the top plate 14 secured thereto by a plurality of bolts 70. The suction cups 20 are shown secured to the underneath side of the base plate 12, with each suction cup being held to the base plate of the tile setter 10 by a single bolt 70.

The air chamber 50 is etched or machined downwardly into the upper surface 13 of the base plate 12 and is sealed by the sealing gasket 16 and the top plate 14. In FIG. 2, the longitudinal runner 52 of the air chamber 50 is shown extending a sufficient length to communicate with each of the suction cups. Vertical runners extend downwardly from the air chamber through the base plate 12 to communicate with appropriate conduits extending through the suction cups 20. As clearly shown in FIG. 2, the sealing gasket 16 and the top plate 14 extend beyond the air chamber, with respect to the length of the air chamber as indicated by the longidudinal runner 52, so as to adequately seal beyond the air chamber lengthwise. Similarly, as may be seen in FIG. 1, the sealing gasket and the top plate overlap the air chamber widthwise. Thus an adequate seal is provided all around for the air chamber. Preferably, the sealing gasket is of substantially the same length and width dimensions as is the top plate 14.

Returning again to FIG. 2, the vertical runner 58 extends downwardly from longitudinal runner 52 through the base plate 12 and it communicates with a conduit 24 in a stem 22 of suction cup 20. The suction cup 20 is secured to the base plate and to the top plate by a bolt extending downwardly also into, but not through, stem 22 of the suction cup 20. Each suction cup includes a stem into which extends a bolt to hold each suction cup to the base plate and to the top plate, as indicated above. Moreover, a vertical runner extends downwardly from the air chamber and communicates with a conduit in the stem of each suction cup to provide communication between the air chamber and each suction cup.

Air chamber 50 also communicates with the thumb release mechanism 40 by means of a conduit 60 which extends through the top plate 14. Extending through the gasket 16 is an aperture 62 which is substantially concentric with the conduit 60, and which allows communication between the conduit 60 and the air chamber 50. A boss 64 is disposed on the top surface of top plate 14 about the conduit 60. The boss is sealingly secured to the top plate. The boss cooperates with the thumb release valve 40 to provide for the ingress and egress of air with respect to the air chamber 50.

The thumb release apparatus seals the interior of the boss 64, and the conduit 60 and aperture 62 and accordingly the air chamber 50 by means of a conical seal 66 secured to the underneath or bottom portion of front tab 44. The front tab 44 is secured to, and comprises a portion of, the thumb tab 42, which extends rearwardly and terminates adjacent the handle 18. The thumb tab 42 and front tab 44 are disposed on and secured to a platform 46 which is in turn secured to upper surface 15 of top plate 14. Adjacent boss 64, the platform 46 is bifurcated to include a pair of upwardly extending arm portions 47, which are substantially parallel to each other, and between which is disposed the front tab 44. The tab 40, including the thumb tab and front tab portions, is secured between the upwardly extending arm portions 47. The tab is held onto the platform by a pin 49 which extends through the upwardly extending arms 47 of the platform 40. A spring 48 is disposed about the pin and provides a bias against the front tab 44 to bias the front tab against the boss 64, which accordingly biases the conical seal 66 into the interior of the boss to seal off the conduit 60 and prevent either air from entering into the air chamber 50 or from escaping from the air chamber.

The suction cups 20 include an upper flange portion 26 and a lower flange portion 28. The upper flange portion 26 is generally hemispherical in configuration, and defines an inner concave portion 27 on the inside of the upper flange portion. The lower flange portion 28 is generally outwardly and downwardly extending from the upper flange portion 26, and it defines an outer concave portion or sealing lip 29 which is adjacent to and radially outwardly of the inner concave portion 27. Between the upper flange 26 and the lower flange 28 is a connecting portion 30. The lower flange 28 extends circumferentially outwardly and downwardly from the upper flange 26. Without the lower flange and the connecting portion, the upper flange 26 and the stem of the suction cup are substantially similar to suction cups of the prior art. However, such prior art suction cups, while performing satisfactorily on a smooth surface, will not provide an adequate seal on textured tile or on any surface which is irregular. Accordingly, the lower flange portion is necessary to provide a seal over a radial distance outwardly from the outer periphery of the upper flange.

Figure 3:
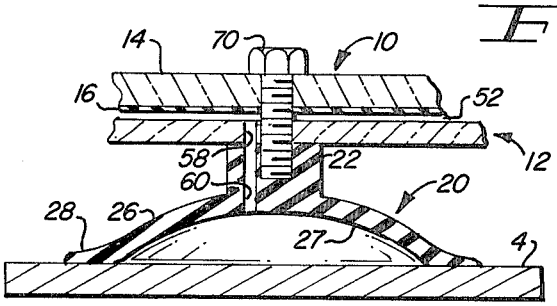
FIG. 3 is a fragmentary view of a portion of the apparatus in FIG. 3 in partial section taken generally along line 3—3 of FIG. 1.

FIG. 3 is a view, enlarged and in partial section, of a portion of the apparatus of FIG. 1 taken generally along line 3—3 thereof. It comprises a view in partial section through a portion of the tile setter apparatus 10 with a suction cup 20 partially secured to a tile 4. As is well known and understood, the inner concave portion 27 will be substantially planar on the tile 4 when the suction cup 20 is fully secured to the tile, rather than merely partially planar as shown in FIG. 3. The outer concave portion or outer sealing lip 29 is shown in FIG. 3 to be substantially planar on the tile 4, with the lower flange portion 28 extending radially outwardly from the upper flange portion 26. Thus maximum suction pressure is achieved by each suction cup of the tile setter apparatus against tile with both flat and textured surfaces by means of the double concavities (the two concave portions) of each suction cup 20.

A portion of the tile setter 10 is shown, including a portion of the upper or top plate 14 secured to the base plate 12 by a bolt 70. Between the top plate 14 and the base plate 12 is the sealing gasket 16, sealingly securing the base plate and the top plate together to seal the longitudinal runner 52 of the air chamber within the tile setter apparatus. Vertical runner 58 extends downwardly through the base plate 12 and communicates with the longitudinal runner 52 and also with the conduit 60 within the stem 22 of the suction cup 20.

In FIG. 3, the tile setter 10 is shown pressed onto a tile 4, with the suction cup 20 adhering to the tile. Accordingly, the lower flange 28 is in contact with a portion of the tile radially outwardly from the upper flange 26, which is also in contact with the tile. The inner concave portion 27 of the suction cup is spread radially outwardly and downwardly, close to the tile, with respect to the stem 22. The operation of the suction cup is similar to other suction cups in the attaching and adhering of the cup to the top surface of the tile 4. That is, as the tile setter 10 is pressed downwardly onto the tile, the suction cup 20 is reduced in its overall height, wiich is the distance between the base plate 12 and the upper surface of the tile 4, and at the same time the vertical height of the suction cup is diminishing, its radial size, or its diameter, is increasing. The total volume between the tile 4 and the inner concave surface 27 of the suction cup is also diminishing. This, of course, results in air being forced out of the area or volume between the suction cup and the tile. The air escapes through the conduit 60, the vertical runner 58, the longitudinal runner 52, and through the air chamber and out the thumb release valve 40 (see FIGS. 1 and 2), or else the air must escape between the lower flange 28 and the tile. Regardless of where the air escapes, the pressure of the air between the tile and the suction cup is diminished to form a partial vacuum. With the partial vacuum, the tile is held by the tile setter 10.

When six tiles, as illustrated in FIG. 1, are picked up by the tile setter 10 by the vacuum process just described in the preceding paragraph, the user of the apparatus lifts the tiles and places the tiles as desired, usually on a vertically extending wall. When the tiles are in their proper place or orientation on a wall, or more particularly on an adhesive surface on a wall, the thumb release valve 40 is actuated to allow air to flow into the air chamber which thus relieves the vacuum and causes the suction cups to be released from the tiles. Some type of index between the suction cups and the base plate may be required to indicate the proper alignment of the conduit 60 of the suction cup and the runner 58.

Figure 4:
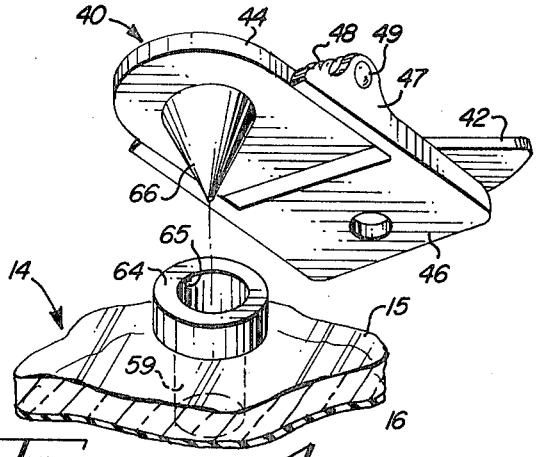
FIG. 4 is an enlarged fragmentary view of a portion of the apparatus of the present invention illustrating the vacuum release.

FIG. 4 is an enlarged fragmentary view of a portion of the apparatus of the present invention illustrating the vacuum release apparatus 40. The thumb release valve 40 is shown spaced apart from the top plate 14 and from the boss 64 disposed thereon. The valve is located so that a user may conveniently actuate the valve with his thumb to release air from the inner concave portion of the suction cups (see FIG. 3) to hold tiles and to admit air to the suction cups to release the tiles substantially simultaneously.

The platform 46 is shown disposed above a top surface 15 of the top plate 14 to which it is normally secured. The platform includes a pair of vertically extending upper arms 47 which comprise a bifurcated channel of the platform 46 in which is movably disposed the front tab 44 of the thumb release valve. The thumb tab 42, which is secured to the front tab, extends rearwardly and upwardly with respect to the platform 46 and is, of course, secured to the front tab 44. The front tab 44 is secured between the upwardly extending or upper arms 47 of the platform 46 by a pin 49 which extends between the upper arms and is secured therein. A spring 48 is disposed about the pin 49 and provides a downward bias on the front tab which results in a downward force of the conical seal 66 within inner conduit 65 of the boss 64. The boss 64 extends upwardly from, and is sealingly secured to, upper surface 15 of the top plate 14. The inner conduit 65 extends axially downwardly through the boss 64 and is coaxial with a vertical conduit or runner 59 which extends through the top plate 14 and communicates with the air chamber 50 (see FIGS. 1 and 2).

The conical seal 66 tapers radially downwardly and inwardly from the lower surface of front tab 44, and its diameter adjacent the front tab 44 is somewhat larger than the diameter of conduit 65 of the boss 64, thus ensuring an adequate seal for the air chamber 50. The conical seal 66 is coaxial with the conduits 59 and 65.

Figure 5:
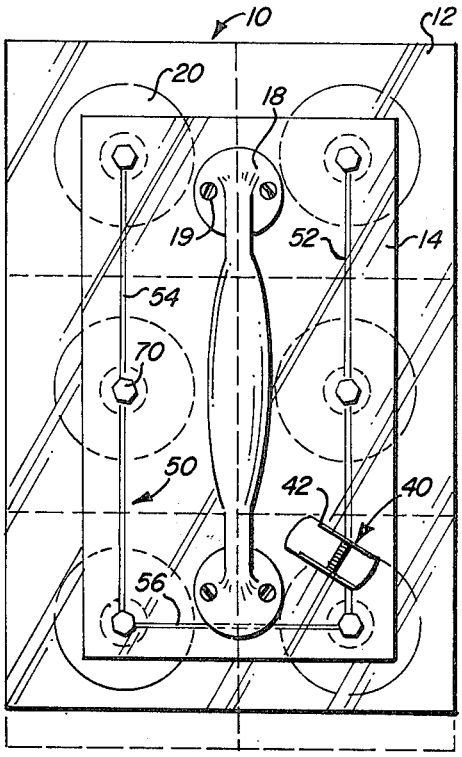
FIG. 5 is a vertical plan view of the apparatus of FIG. 1.

FIG. 5 is a vertical plan view of the apparatus of FIG. 1, showing the tile setter 10 secured to a plurality of tiles. The tile setter 10 is shown disposed over six square tiles, which are typically about four and a quarter inches by four and a quarter inches, but which may be larger or smaller, depending on the specific tile. The tiles are illustrated in FIG. 5 by dotted lines. Similarly, the plurality of suction cups 20, which extend downwardly from beneath the base plate 12, are indicated in phantom by dotted lines.

The handle 18 is shown secured to the top plate 14 by screws 19. Each suction cup 20 is secured to the top plate 14 and the base plate 12 by a single bolt 70 which extends downwardly from the top surface of the top plate, through the top plate, through the base plate, and into the stem of the suction cup (see FIGS. 2 and 3). Each suction cup communicates with the air chambers 50 by vertical runners extending through the base plate which in turn communicate with a conduit in the stem of each suction cup (see FIGS. 2 and 3). The air chamber 50 is defined by a pair of longitudinal runners 52 and 54 connected by a lateral runner 56. The air chamber 50 is also connected to a thumb release valve 40 which is actuated by a thumb tab 42 located conveniently accessible to a right-handed user of the tile setter 10 by being disposed at, by definition, the forward or front portion of the tile setter 10 and adjacent to the front left portion of the handle 18. In this position, the release valve may be conveniently actuated by the thumb of the user of the apparatus.

FIG. 6 is a perspective view of tile holder box apparatus 80 of the present invention with a plurality of tiles disposed and oriented therein. The box includes a rectangular bottom or base 82, a pair of side walls 84 and 86, and a front wall 88. The overall configuration of the tile holder box 80 is rectangular, with the width being substantially greater than the length. That is, the distance between the side walls 84 and 86 is greater than the length of the box, as defined by the length of the sides, or the distance between the front wall 88 and the open back or rear portion of the box. A pair of handles are secured to the sides of the box, with handle 90 shown secured appropriately, as by screws, to side 84. The handle 90 is substantially the same as handle 18 of the tile setter 10, and is secured in substantially the same manner, as by screws. One handle is secured to each end to allow a user of the apparatus to move, as by sliding, the box as he desires to a location convenient to where the tile is to be installed. The sides 84 and 86 are secured to both the bottom or base 82 and the front wall 88.

Within the box 80 is a pair of foldable or pivotally movable interior walls 100 and 120. The walls 100 and 120 are disposed substantially parallel to the ends 84 and 86, by a pair of piano hinges 102 and 122. The walls 100 and 120 are spaced apart from each other and are spaced apart from their respective side walls 84 and 86 sufficient to allow a pair of tile side by side to be disposed or placed between the respective ends and the interior walls. A pair of compartments are thus defined between the respective end walls and the interior walls. A compartment 96, open at one end, is defined between the side wall 84, the interior wall 102, and the front wall 88. A second compartment, compartment 98, is defined between end wall 86, interior wall 120, and front wall 88. In FIG. 6, compartment 96 is shown with a plurality of layers of tile disposed therein. Each layer of tiles comprises two rows disposed side by side of three tiles each, thus providing a total of six tiles in a single layer. The six tiles in a layer are accordingly compatible with, and correspond to, the six tiles illustrated with the tile setter apparatus 10 of FIGS. 1–5. The disposition or orientation of the tiles within each compartment, and the removal of the tiles from the compartment, by the tile setter 10 will be discussed below in conjunction with FIG. 7.

The interior walls 100 and 120 each include a longitudinal bevel which extends the full length of the walls adjacent the bottom 82 of the tile setter box 80. Bevel 104 is shown at the bottom of interior wall 100 and bevel 124 is shown at the bottom of interior wall 120. The bevels 104 and 124 are disposed on the bottom of the movable interior walls and within or towards the respective compartments 96 and 98, and on the opposite sides of the interior walls from the piano hinges. The bevels provide a camming surface for camming the bottom layer of tiles into appropriate longitudinal or side-by-side relationship with each other within each of the compartments. With the camming action of the bevels, the tiles, such as ceramic tiles, are not broken, as may happen if the lower corner of the movable walls included a sharp edge, such as the other edges of the walls, which are 90° edges. Rather, the bevel provides an appropriate cam surface for urging the tiles into correct alignment within each compartment of the box.

For loading the compartments, the interior walls may be folded inwardly toward the center of the box, which is located between the two movable walls and a box of tiles may be appropriately set in each compartment. When the tiles are set in a compartment, the cardboard box or holder of the tiles may be then lifted or removed. During the insertion of the tiles, or the loading of the tiles, into the compartments of the box, it is more convenient to have the interior walls folded out of direct contact with the cardboard shipping boxes in which the tiles are packed. However, during the loading of the compartments the tiles will obviously not remain in their correct orientation. When the shipping container or box has been removed, or after the tiles are manually stacked in a compartment, the adjacent interior wall is then moved vertically on its piano hinge and it appropriately cams the tiles into correct alignment. The open end of the box 80 also enhances the loading of the tiles and allows the user to push the tiles forward manually against the front wall 88. The loading of each compartment is substantially identical. If desired, a user may pivot the interior walls away from the respective fixed side walls each time a layer of tiles is picked up to maintain the orientation of the tiles by the camming action of the interior walls against the remaining layers of tiles.

FIG. 7 is a side view of the apparatus of FIG. 6, showing a plurality of tiles disposed in the box and also showing, in the phantom, a tile setter 10 disposed in compartment 98 of the box. Both handles are shown secured to the box, with handle 90 being secured to side wall 84 and a handle 92 shown secured to side wall 86. The side walls 84 and 86 are shown secured to and extending between the bottom 82 and the front wall 88. Interior walls 100 and 120 are shown extending vertically upward within the box 80 and each is shown disposed against a plurality of layers of tile 4.

The compartment 96 is substantially full of tile, while the compartment 98 has a layer or two less tiles, with a tile setter 10 shown disposed on the uppermost layer of tiles within the compartment 98. Note that there is a space within compartment 96 between the top layer of tiles 4 and the top of the walls of the compartment. This space is used by a portion of the tile setter apparatus 10, shown in compartment 98. The base plate 12 (see FIGS. 1, 2 and 5) with the suction cups extending downwardly therefrom, should be within the three walls of a compartment in order to orient the tile setter with the six tiles to correctly and easily install the tiles properly oriented with respect to each other. The alignment of the tiles within each compartment is accomplished by two fixed walls and a movable wall and by the user manually moving the tiles from the rear or back in place of the fourth wall. Since the base plate of the tile setter is substantially the same size as the layer of six tiles, the tile may be properly aligned by disposing it within a compartment and adjacent or contiguous to the three walls. The tiles will then be correctly aligned with respect to each other and to the tile setter for proper installation.

The walls 100 and 120 are respectively secured to the bottom 82 by the piano hinges 104 and 124, which, as indicated above, preferably run the entire length of the box 80. Bevels 104 and 124 of the interior movable walls 100 and 120, respectively, are shown at the lower portion of the interior walls adjacent the bottom 82.

FIG. 8 is a vertical plan view of the apparatus of FIG. 7, showing the tile setter 10 disposed within compartment 98 of the tile setter box 80. Within compartment 96 is shown the top layer of tile 4, comprising six individual tiles disposed adjacent each other in two columns of three tiles each. The compartment 96 is defined by the side wall 84, the movable interior wall 100, and the front wall 88. Within compartment 98 is shown the tile setter 10 disposed on the top layer of tile within the compartment. Compartments 96 and 98 are substantially identical and accordingly hold a plurality of layers of six tiles, in two rows or columns of three tiles each, preferably about thirteen layers, or about ten square feet each, for a total of about twenty square feet per box (see also FIGS. 6 and 7). Handles 90 and 92 are shown extending outwardly from the side walls 84 and 86. The interior movable walls 100 and 120 are shown secured to the bottom 82 by piano hinges 102 and 122, respectively. The piano hinges extend the length of the box, and accordingly along the full length of the movable interior walls.

For practical reasons, it is preferable to make both the tile setter 10 and the tile holder box 80 out of clear materials so that the tiles used with the apparatus may be clearly seen. Appropriate material may be used for thus fabricating the tile setter and the tile holder box, such as methylmethacrylate. The thickness of the material should be such as to impart sufficient strength to the apparatus to hold the tiles and also to absorb the necessary wear, tear, and even abuse, that is typical of the use environment in which the apparatus is used.

As is known and understood, ceramic tile, which the apparatus will typically be used with, is relatively heavy and accordingly the height of the box 80 need only be sufficient to hold about thirteen layers of six tiles each, plus the added height of the suction cups and base plate of the tile setter, as discussed above. A layer of six tiles has been selected, and is illustrated herein, as being a number of tiles which can be conveniently lifted into place by the tile setter from the tile holder box by a user working in a convenient manner. The number could be enlarged, if desired, or could be reduced if desired. However, six tiles appears to be an appropriate number to maximize the efficiency of the user and still provide the user with a sufficient number of tiles at a single time to both maximize his efficiency and minimize the inherent problems of placing and adjusting the tiles and also considering the weight of the tiles which must be picked up and put into position. With the tile holder box apparatus including two compartments, each of which is loaded with several layers of six tiles per layer, a workman can efficiently set the tile from a single source, which is the box, using the tile setter to pick up and place six tiles at a time. With typical tile size being about four and a quarter inches square by about one quarter to five sixteenths inches in thickness, a single layer of tiles, comprising six tiles, covers about one hundred eight square inches and accordingly two complete compartments will cover nearly twenty square feet. However, two full compartments in a single box will also be quite heavy. Accordingly, the handles on the sides allow a box to be conveniently moved as by sliding over a floor to again maximize the efficiency of the user of the apparatus by providing the tiles as close to his work area as possible. It may be noted that the length and height of the walls (and the length and width of the base plate of the tile setter) are predetermined in accordance with the desired size of the compartments vis-a-vis the dimensions of the tiles, the number of layers of tiles desired, and the size (height) of the tile setter from suction cup flanges to the top plate.

Figure 9:
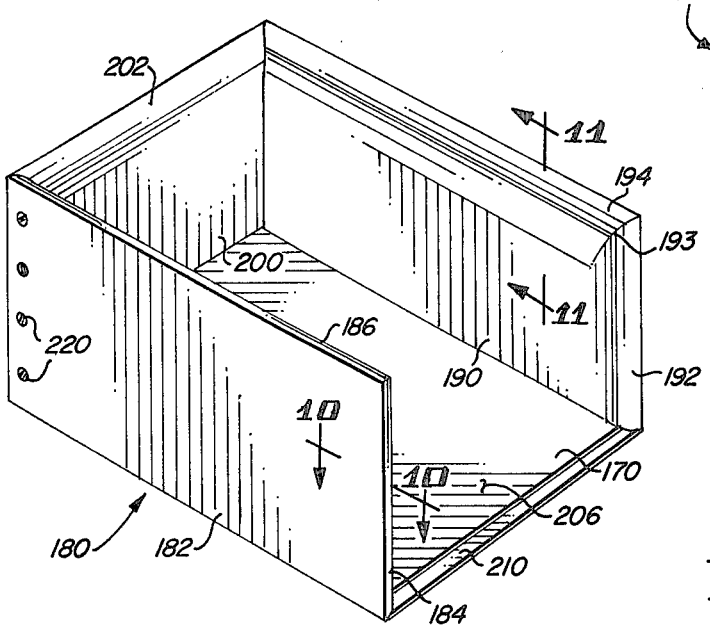
FIG. 9 is a perspective view of an alternate embodiment of a tile holder box.

FIG. 9 is a perspective view of an alternate embodiment of a tile holder box, comprising a perspective view from the front and side of a tile holder box 180. The box 180 includes only three sides, side 182, side 190, and end 200, without a bottom and without a top. The sides and the end are secured together by appropriate fastening means, such as screws.

The side wall 182 includes a pair of beveled portions, end or vertical beveled portion 184 and top or horizontal beveled portion 186. Similarly, the side wall 190 includes a pair of beveled portions, end or vertical beveled portion 192 and top or horizontal beveled portion 194. At the juncture of the two beveled portions, 192 and 194, is an edge 193. The rear end wall 200 includes only a single beveled portion, top or horizontal beveled portion 202. The top or horizontal beveled portions 186, 202, and 194 are substantially alike in curvature, radius, etc.

The side walls preferably are joined to the end wall by square butt joints, secured together by a plurality of appropriate fasteners, such as a plurality of countersunk flat head screws 220. The butt joints provide the ease of manufacture and the strength needed for the box. If desired, external braces could also be used to reinforce the corners.

No fixed bottom is provided for the tile holder box 180. Rather, the apparatus is designed so as to allow the bottom of a box, such as a shipping box, in which tile are shipped to a job, to be used as the bottom. The dimensions of the sides, lengthwise and heightwise, of the tile holder box 180 are substantially the same as the sides and a portion of the end of the tile holder box 80 of FIGS. 6–8, with the exception that the sides 182 and 190 are elongated slightly to accommodate a support strap 210 at the entrance to the box, remote from the rear end wall 200. The strap extends between the walls 182 and 192 at the bottom of the walls, and is secured thereto by appropriate fasteners, such as countersunk screws. The bottom of the walls are preferably relieved to receive the strap and to provide a flush, continuous bottom to the three walls of the box. The space within the box 180 between the strap 210 and the end wall 200 is sufficient to receive a carton of tiles. The strap helps to support the walls 182 and 190 and to keep them appropriately spaced apart. The strap is preferably made of metal.

Tile holder box 80 includes two compartments while the box 180 includes only a single compartment 206, into which is disposed substantially the same square footage of tile as in a single compartment, such as either compartments 96 or 98, of the embodiment of FIGS. 6–8. Typically, about ten square feet of tile may be disposed in a single compartment, such as compartment 206, compartment 96, and compartment 98. Accordingly, tile holder box 80 holds typically about twenty square feet of tile, while tile holder box 180 holds only about ten square feet of tile.

When a single box of tile, which holds about ten square feet, as referred to in the previous paragraph, is required, the box or carton of tiles may be disposed adjacent the holder 180. With a convenient zip-type carton opening employed, the sides and the top of the box or carton of tile may be removed, leaving the tiles in two columns of three tiles each, such as shown in FIGS. 6–8, (see FIG. 13) and the carton of tile, without the carton, or with only the bottom of the carton, such as indicated by reference numeral 170 in FIG. 9, may then be disposed within the box 180. The orientation of the tile within compartment 206 of the box 180 may easily be accomplished by slipping the box 180 directly onto the stack of tiles. The beveled portions 184 and 192 act as camming surfaces to facilitate the entry of the tiles into the chamber or compartment 206.

Since the three sides, side walls 182, 190, and end wall 200, are relatively rigid, and do not include a movable, folding wall, such as walls 100 and 120 of box 180, shown in FIGS. 6–8, the fit of the carton of tiles within the box 180 should be precise in order to appropriately align the tiles for directly setting them by use of the tile setter apparatus as discussed and illustrated previously, and as will be discussed in addition below. The vertical beveled portions 184 and 192 are accordingly important in properly camming and aligning the tile within the holder 180.

The top bevels 186, 202, and 194, are used as an aid in receiving a tile setter within the box since the tile setter exterior dimensions are substantially the same as the inside dimensions of the box 180 with respect to the compartment 206. Tile setter insertion is enhanced by the bevels.

Figure 10:
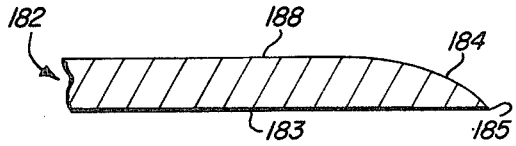
FIG. 10 is a view in partial section of a portion of the apparatus of FIG. 9, taken generally along line 10—10 thereof.

FIG. 10 is a view in partial section of a portion of side 182 taken generally along line 10—10 of FIG. 9. It comprises a plan view, in partial section, of a portion of wall 182, looking downwardly through the wall. The wall 182 includes an outer or outside surface 183, and an inner or inside surface 188. The inside surface 188 comprises an interior side against which the tile are disposed. The surfaces 183 and 188 are substantially parallel to each other. The end bevel 184 extends from the outside surface or outer surface 183 smoothly to the inside or interior side 188. At the juncture of the outer surface 183 and the beveled portion 184 is a vertical edge 185. From the edge 185, the bevel 184 extends rearwardly in a very smoothly curving manner until it blends with the interior side 188. The bevel 184 comprises a convex surface which extends between the edge 185 and the interior side 188.

Figure 11:
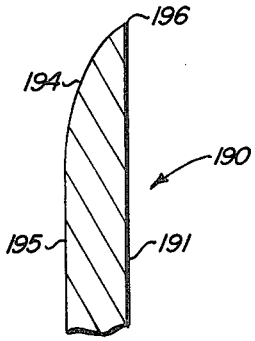
FIG. 11 is a view in partial section of a portion of the apparatus of FIG. 9, taken generally along line 11—11 thereof.

FIG. 11 is a view in partial section of a portion of the apparatus of FIG. 9 taken generally along line 11—11 of FIG. 9, and showing a portion through the side 190. The top bevel 194, which extends horizontally along the top of the wall 190, is clearly illustrated.

The wall 190 includes an exterior surface 191 and interior surface 195. The bevel 194 extends from the outside wall surface 191 to the inside wall surface 195 and comprises a concave type curvature. An edge 196 is defined at the juncture of exterior surface 191 of the wall 190 and the bevel 194. From the edge 196, which is the uppermost portion of the exterior surface 191 of the wall, the bevel 194 extends smoothly downwardly in a convex curve to the inside surface 195. The surface 191 and 195 are substantially parallel to each other. The radius of curvature, of all of the beveled portions, such as the bevel 194 of FIG. 11 and the bevel 184 of FIG. 10, regardless of whether they are end bevels or top bevels, as illustrated in FIGS. 10 and 11, may preferably be the same with respect to the curvature.

Figure 12:
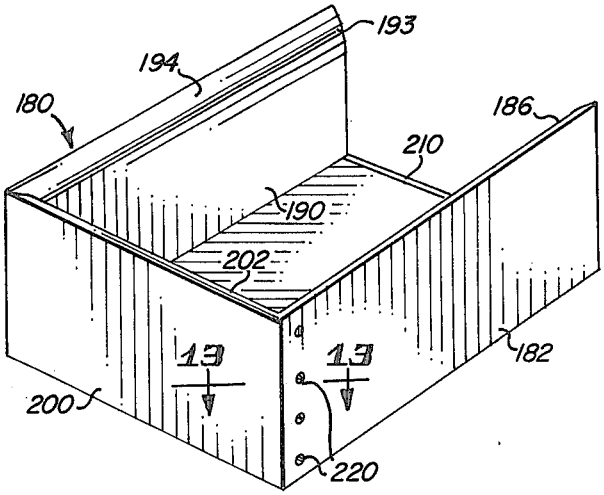
FIG. 12 is a perspective view of the apparatus of FIG. 9 looking at the box apparatus from the rear and from the side.

FIG. 12 is a perspective view of the box 180 taken from a different view from that illustrated in FIG. 9. It is a perspective view from the rear and side, showing a plurality of screws 220 used to secure together the adjacent walls 182 and 200. Similar screws are used to secure together the walls 190 and 200.

The respective top bevels 186 of wall 182, 202 of wall 200, and 194 of wall 190, are illustrated in FIG. 12. The juncture or edge 193 of the bevels 194 and 192 (see FIG. 9) is also shown in FIG. 12.

Figure 13:
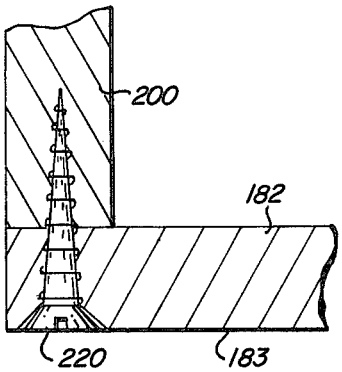
FIG. 13 is a front view of the box apparatus of FIGS. 9–12 illustrating the use of the box.

FIG. 13 is a view in partial section of a portion of the apparatus of FIG. 12, taken generally along line 13—13 of FIG. 12. It comprises a view of the corner of the tile holder box 13 illustrating the butt joint of the side wall 182 and the rear end wall 200, and the fastening means employed to secure the two walls together. A screw 220 is shown countersunk or recessed below the outer surface 183 of the wall 182 and extending into the interior of end wall 200. As previously indicated, and as illustrated in FIGS. 9 and 12, a plurality of such flat head screws 220 may be used, with the quantity of screws determined as necessary and required for strength.

Figure 14:
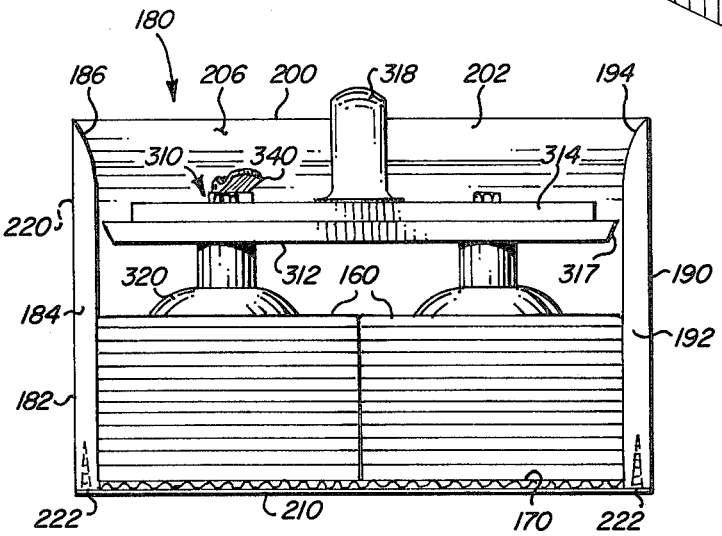
FIG. 14 is a view in partial section of a portion of the apparatus of FIG. 12 taken generally along line 14—14 of FIG. 12.

FIG. 14 is a front view of the tile holder box 180 illustrating the use of the box by showing a plurality of layers of tiles 160 disposed on a cardboard box bottom 170 within the box, between the parallel sides 182 and 190, and also against the end wall 200. As above indicated, the dimensions of the walls are predetermined according to the dimensions of the tiles and the tile setter.

The support strap 210 is shown at the bottom of the side walls 182 and 192, secured thereto by a pair of screws 222, shown in phantom. The screws 222 are preferably flat headed screws, recessed into the strap 210 to provide a flush bottom to the strap and also to the box 180.

Shown disposed within compartment 206 of the tile holder box apparatus 180 is a tile setter apparatus 310, which is substantially the same as tile setter apparatus 10 of FIGS. 1-5, with the exception of a beveled edge 317 on the outer periphery of base plate 312. The dimensions of the tile setter 310 are substantially identical to the tile setter 10, described in detail above, and the dimensions are, with respect to length and width, the same as the interior of the tile holder box 180, except for the elongated portion which accommodates the support strap 210, as discussed above.

With respect to the tile setter 310, a top plate 314 is sealingly disposed on the base plate 312, as described above, and a handle 318 is in turn secured to the top plate 314. Secured to and extending beneath the base plate 312 are a plurality of suction cups 320. A thumb actuated vacuum release valve 340 is disposed on the top plate 314 adjacent the handle 318.

Details of the tile setter 310, such as the air chamber in the base plate 312, with its conduits to the suction cups, the gasket which seals the air chamber between the base plate 312 and the top plate 314, and the screws and bolts which are used to secure respectively the handle to the top plate and the suction cups to the top plate and base plate, and various details of the thumb actuated vacuum release valve 340 have been omitted from FIG. 14 for clarity and also because the details are substantially as shown above, or, in the alternative, as in the embodiments of FIGS. 15-18, discussed in detail below.

Since the wall 182, 190, and 200 are fixed in position and do not move, the orientation of the tile setter 310 into the compartment 206 is enhanced by the beveled portions 317, which extend around the base plate 312. With one end of the box 180 open, it is not necessary to have the outer rear end or edge (i.e., the end or edge toward the open side) of the tile setter beveled, but the two sides and the forward end should preferably be beveled. The beveled portions of the base plate cooperate with the beveled portions 186, 194, and 202 of the three sides to allow the tile setter to move into the interior of the box and onto the tiles disposed in the box in a convenient manner. The respective beveled portions act as guides or cams to help move the tile setter into the compartment 206.

Figure 15:
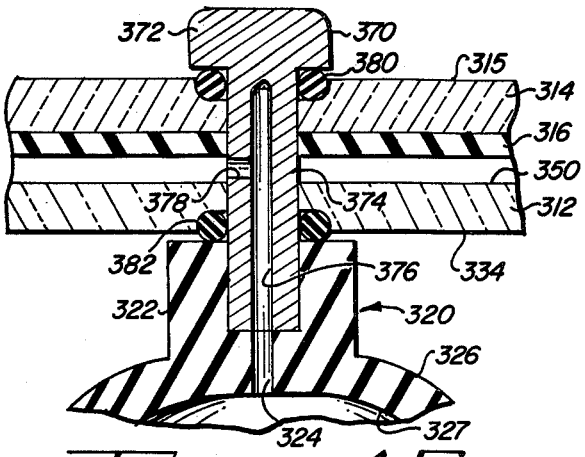
FIG. 15 is an enlarged view in partial section of an alternate embodiment of a portion of the tile setter apparatus of FIGS. 1–5.

FIG. 15 is an enlarged view in partial section of a portion of a tile setter apparatus, such as tile setter apparatus 310 of FIG. 14, illustrating an alternate embodiment of a portion of the tile setter. The alternate embodiment of FIG. 15 comprises using passageways through the bolt which is used to secure the suction cups to the top plate and the base plate for connecting the air chamber with the suction cup rather than use separate passageways or conduits in the base plate and in the suction cup.

In FIG. 15 is shown a portion of a base plate 312, a top plate 314, an air chamber 350 extending downwardly into a base plate 312 from the top of the base plate, and a gasket 316 which is disposed between the base plate and the top plate to seal the air chamber between the two plates. Extending beneath the base plate 312 is a suction cup 320, which includes a stem 322 and an upper flange 326. Disposed beneath the flange 326 is a concave chamber 327 which comprises the vacuum chamber when the cup is sealingly secured to a tile. Within the stem 322, and communicating with the concave chamber 327, is a conduit 324.

The suction cup 320 is secured to the base plate and the top plate, and the two plates are held together, by a bolt 370. The bolt 370 includes a head 372 and a shank 374 extending downwardly from the head and through the top plate 314, sealing gasket 316, through the air chamber 350, through the base plate 312, and into the stem 322 of the suction cup 320. Centrally disposed within the shank 374 of the bolt 370 is a passageway or conduit 376, which is drilled axially through the shank of the bolt. The passageway or conduit 376 communicates with conduit 324 in the suction cup 320. To provide communication between the passageway 376 and the air chamber 314 is an aperture 378 which extends radially through the shank of the bolt. Thus there is provided direct communication between the air chamber 350 and the chamber 327 of the suction cup 320 through the conduit 324, passageway 376, and aperture 378.

In order to insure that the bolt 370 is sealingly secured to the suction cup and to insure an appropriate seal with respect to the base plate 312 and the top plate 314, a pair of O rings may be used. An O ring 380 is shown disposed beneath the head 372 of the bolt 370 and against the top plate 314. Another O ring 382 is shown disposed about the shank 374 of the bolt 370 between the stem 322 of the O ring 320 and the base plate 312. The O rings 380 and 382 are shown disposed in appropriate recesses on outer surfaces 315 and 334 of the top plate 314 and the base plate 312, respectively. If desired, the recesses may be omitted.

Figure 16:
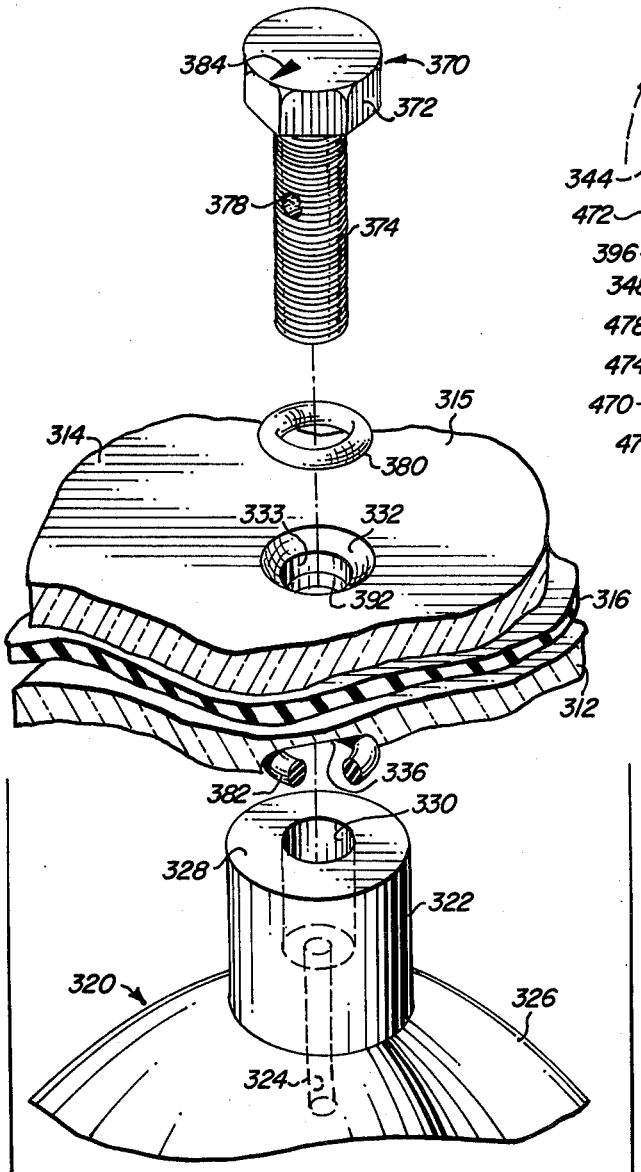
FIG. 16 is an enlarged, exploded view, in partial section, of the apparatus of FIG. 15.

FIG. 16 is an enlarged exploded view of the apparatus of FIG. 15. Bolt 370 is shown spaced apart from the top plate 314, sealing gasket 316, base plate 312, and the suction cup 320.

The bolt 370 is illustrated as being a hex head bolt, with a head 372 and a threaded shank 374. Aperture 378 is shown extending radially inwardly of the threaded shank portion 374 of the bolt. Radially aligned with the aperture 378 is an index mark 384 disposed on the top of the head 372. The index 384, being parallel with the aperture 378, allows the bolts 370 to be appropriately oriented to align the aperture 378 with a runner of the air chamber 350 (see FIG. 15). The index mark 384 may be any appropriate mark, such as a cut, groove, or the like, either on the top of the head or on a flat side of the head. Since the main purpose is to allow orientation of the bolt for proper alignment of the aperture 378 and the air chamber on the base plate, any appropriate identification feature may be used.

An O ring 380 is shown spaced apart from the shank 374 of the bolt 370 and the top plate 314. The O ring is disposed above a recess 332 which extends concavely downward from the top surface 315 of the top plate 314.

The recess 332 is concentrically disposed with respect to a bore or aperture 333 which extends through the top plate 314. The bore or aperture 333 is also coaxial with an aperture 392 in the gasket 316. Similarly, there is another coaxial bore or aperture in the base plate 312, and all of the apertures receive the threaded shank of the bolt 370.

Extending upwardly from the bottom surface 334 (see FIG. 15) of the base plate 313 is a recess 336 in which is disposed the O ring 382. The shank 374 of the bolt 370 extends through both O rings 380 and 382, and through the top plate 314, gasket 316, and base plate 312.

Shown beneath the base plate 312 is the suction cup 320, with its stem 322 extending upwardly adjacent the O ring 382. The stem 322 of the suction cup 320 includes a top surface 328. The stem 322 is substantially cylindrical in configuration, and the top surface 328 is accordingly substantially perpendicular to the axis of the cylindrical stem 322. Extending downwardly from the top surface 328, and along the axis of the cylindrical stem 322, is a bore 330 which receives the lower portion of the threaded shank 374 of the bolt 370. The conduit 324 extends downwardly from the lower portion of the bore 330 to provide communication between the bore, with respect to the passageway 376 within the shank 374 of the bolt (see FIG. 15) and the chamber 327 beneath the upper flange 326 of the suction cup (again see FIG. 15).

Figure 17:
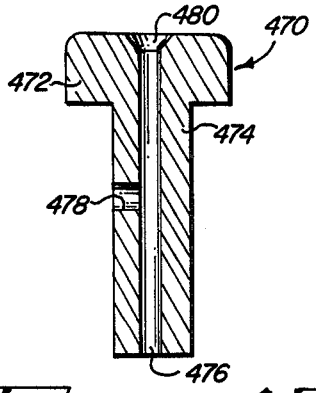
FIG. 17 is a view in partial section of an alternate embodiment of a bolt usable with the alternate embodiment of the tile setter as illustrated in FIGS. 15 and 16.

FIG. 17 comprises an alternate embodiment of the bolt 370 of FIGS. 15 and 16. Bolt 470 includes a head 472 and a threaded shank 474, both of which are substantially the same as the head and shank of the bolt 370. However, the bolt 470 is adapted to be used with a thumb actuated vacuum release valve, such as illustrated and discussed above in conjunction with FIGS. 1, 2, and 4, or as illustrated and discussed below in conjunction with the alternate embodiment shown in FIG. 18. The bolt 470 accordingly has a passageway or aperture 476 drilled throughout the length of the bolt, including both the shank 474 and the head 472. At the top surface of the head 472 is a conical chamfer 480 which is disposed about the passageway or aperture 476 to receive a portion of a sealing member on the release valve to seal the passageway.

An aperture 478 extends radially outwardly from the passageway 476 through the shank 474 of the bolt. Again, an index of some type should be employed on the head 470 in radial or parallel alignment with the aperture 478 to allow for proper alignment between the aperture and an air chamber or runner in a title setter apparatus.

Figure 18:
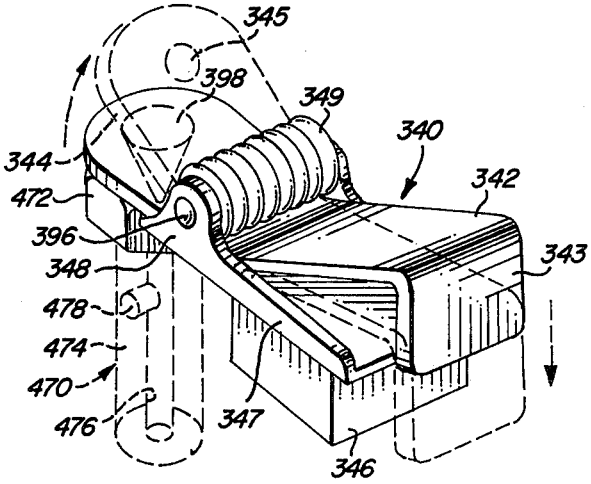
FIG. 18 is a perspective view of an embodiment of a vacuum release valve for a tile setter.

FIG. 18 is a perspective view of an alternate embodiment of a thumb actuated release valve, comprising a thumb release valve 340 which in most respects is similar to the thumb release valve 40 illustrated in FIGS. 1, 2, and 4. The thumb release valve 340 includes a thumb tab 342 extending upwardly and rearwardly from a front tab 344 which is disposed substantially parallel to a top plate of a tile setter apparatus on which the release valve is used. In FIG. 18, the release valve is shown employed with a bolt 470, from the embodiment of FIG. 17, which includes an aperture or passageway extending through the bolt. The front tab 344 is shown disposed adjacent the head 472 of the bolt.

To compensate for the thickness of the head 472 of the bolt, the release valve 340 is disposed on a platform or block 346 which in turn is disposed on and secured to the top plate of the tile setter apparatus. A tab base 347 is secured to the block 346 and supports the tabs 342 and 344.

The tabs 342 and 344 are secured to the tab base 347 between a pair of vertical arms 348 which extend upwardly from the tab base 347. A pin 396 extends between the arms 348. A spring 349 is coiled about the pin 396 which extends between the vertical arms 348. The spring biases the front tab 344 against the head 472 of the bolt.

Shown in phantom in FIG. 18 is the shank 474 of the bolt 470, with the axially extending passageway 476 and the connecting radially extending passageway 478. The tab portions are also shown in phantom in an actuated or operative position such as occurs when the thumb of the user presses on the thumb tab 342 to raise the front tab 344 against the bias of the spring 349. When the front tab is moved upwardly from the head 472 of the bolt, the passageway 476, and also the passageway or aperture 478, is vented to atmospheric pressure by removing a sealing stopper or bumper 398, shown in phantom, from the upper portion of the passageway 476. Another aperture 345 is also shown in phantom in FIG. 18 in the upright or raised position of the front tab 344. If desired, a common conical or rounded bumper may be employed with the vacuum release valve 340, in which the head of such bumper or stopper is inserted through an aperture, such as aperture 345, and in turn locks the lower or bottom conical or rounded bumper portion to the tab. When the pressure or force of a thumb is removed from the thumb tab 342, the force of the spring 349 against the front tab 344 biases the bumper into sealing engagement with the aperture in the head of the bolt.

Extending downwardly, at substantially a right angle, or more, from the rear of the thumb tab 342, is a stop tab 343. The purpose of the stop tab is to limit the downward movement of the thumb tab by providing a stop against the top plates of the tile setter apparatus. Thus the distance which the thumb tab moves is limited by the length (or height) of the stop tab 343. In this manner a sufficient force may be exerted by the user's thumb against the thumb tab to lift the front tab with its bumper or stopper off the aperture or passageway which it seals a sufficient distance to allow communication with the atmospheric or ambient air pressure, and yet limit the movement of the user's thumb and accordingly of the thumb tab to a predetermined amount. Also, the limit of movement of the thumb is accordingly a fixed and definite distance with each use and is a small enough distance so that the tile setter apparatus remains under firm control of the user at all times without an excessive or awkward movement of the thumb which may occur in the absence of some stop tab. Obviously, such stop tab may also be employed with the embodiment of the release valve 40 of FIGS. 1, 2, and 4. Moreover, the specific design of the bumper or stopper, whether conical, rounded, or some other configuration, may be any appropriate configuration to provide an adequate seal for the air chamber of the tile setter apparatus. Similarly, the strength of the spring employed to provide a bias for the stopper or bumper need only be sufficient to provide an adequate seal for the tile setter apparatus.

The above described tile setting apparatus comprises a tile setter and a tile holder box which cooperates to provide tiles in a predetermined and prealigned arrangement for a simultaneous pickup of a plurality of such tiles. comprising a single layer, by the tile setter apparatus.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Apparatus for setting tile, comprising, in combination, box means for holding and orienting a plurality of layers of tiles, and each layer of tiles comprising a plurality of tiles, including a first side wall of a predetermined length, a second side wall of a predetermined length substantially parallel to the first side wall and spaced apart therefrom, and an end wall extending between and substantially perpendicular to the first and to the second side walls, said side walls and end wall defining a compartment of a predetermined width and length for holding a plurality of layers of tiles in a predetermined orientation:

tile setter means for securing a plurality of tiles comprising a layer of tiles and removing the plurality of tiles from the box means to set the plurality of tiles at a desired location and for releasing the plurality of tiles substantially simultaneously, including plate means including a portion having a predetermined width and length of substantially the same width and length as the compartment for insertion into the compartment, suction cup means including a plurality of suction cups secured to the plate means in a predetermined orientation corresponding to the orientation of the tiles in a layer of tiles in the box means for securing to the said tiles in a layer upon appropriate evacuation of air between the tiles and the suction cups, each suction cup having two concavities when not secured to a tile including an upper flange portion of a generally hemispherical configuration defining an inner concave portion, and a lower flange portion extending outwardly and downwardly from the upper flange portion defining an outer concave sealing lip portion, and each concave portion being substantially planar when secured to a tile;

air chamber means in the plate means communicating with each cup of the plurality of suction cups;

fastening means for securing the suction cup means to the plate means and including a shank extending from the plate means to each suction cup and an axially extending conduit in the shank communicating with each cup and an aperture extending radially from the conduit to the air chamber means for providing communication between the air chamber means and each cup; and valve means communicating with the air chamber means for selectively releasing air from and admitting air to the air chamber means.

2. The apparatus of claim 1 in which the plate means includes a base plate having the predetermined width and length and a top plate secured to the base plate.

3. The apparatus of claim 2 in which the air chamber means is disposed in the base plate and the valve means is secured to the top plate.

4. The apparatus of claim 3 in which the air chamber means includes a plurality of runners connected to each other on the base plate adjacent the top plate and a gasket disposed between the base plate and the top plate to provide a seal for the runners and the top plate.

5. The apparatus of claim 4 in which the valve means includes a conduit extending through the top plate and communicating with a runner of the air chamber means.

6. The apparatus of claim 5 in which the tile setter means includes a handle disposed on and secured to the top plate and the valve means is disposed adjacent the handle.

7. The apparatus of claim 6 in which the base plate includes beveled portions for guiding the tile setter means into the compartment.

8. The apparatus of claim 7 in which each suction cup includes a conduit extending from the inner concave portion and communicating with the air chamber means.

9. The apparatus of claim 8 in which the suction cups each include a connecting portion between the upper flange and the lower flange.

10. The apparatus of claim 1 in which the box means includes a third side wall of a predetermined length and a fourth side wall of a predetermined length and both substantially parallel to each other and to the first and second side walls and disposed substantially perpendicular to the end wall, said third and fourth side walls and the end wall defining a second compartment of a predetermined width and length for holding a plurality of layers of tiles in a predetermined orientation.

11. The apparatus of claim 10 in which the box means further includes a bottom secured to the end wall and to the first, second, third, and fourth side walls.

12. The apparatus of claim 11 in which the first side wall and the fourth side wall are secured to the end wall.

13. The apparatus of claim 12 in which the second and third side walls are movably secured to the bottom and pivot with respect thereto and respectively away from the first side wall and the fourth side wall to enhance the loading of the tiles into the compartments and to aid in maintaining the orientation of the tiles in the compartments.

14. The apparatus of claim 13 in which the second and third side walls include beveled portions adjacent the bottom for camming against tiles disposed in the respective compartments to help orient the tiles in the compartments.

15. The apparatus of claim 1 in which the first side wall and the second side wall are secured to the end wall.

16. The apparatus of claim 15 in which the box means includes a support strap extending between and secured to the first side wall and the second side wall remote from the end wall for providing support for the side walls.

17. The apparatus of claim 16 in which the first side wall, the second side wall, and the end wall include top beveled portions for enhancing the insertion of the tile setter means into the compartment.

18. The apparatus of claim 17 in which the first side wall and the second side wall include end beveled portions for enhancing the entry and alignment of tiles into the compartment.

* * * * *